United States Patent [19]

Hoffman

[11] Patent Number: 4,850,302

[45] Date of Patent: Jul. 25, 1989

[54] APPARATUS FOR APPLYING ELECTROSTATICALLY CHARGED PARTICLES TO THE SURFACE OF A LARGE METAL ARTICLE

[75] Inventor: Reinhold Hoffman, Sprockhovel, Fed. Rep. of Germany

[73] Assignee: Interlock Corporation, Cleveland, Ohio

[21] Appl. No.: 110,217

[22] Filed: Oct. 19, 1987

Related U.S. Application Data

[63] Continuation-in-part of Ser. No. 821,802, Jan. 23, 1986, abandoned.

[51] Int. Cl.[4] ..... B05B 5/02; B05C 11/00; B05C 13/02; B05C 19/00

[52] U.S. Cl. ..... 118/629; 118/58; 118/107; 118/600

[58] Field of Search ..... 118/58, 107, 308, 320, 118/321, 600, 629; 427/29, 318, 425

[56] References Cited

U.S. PATENT DOCUMENTS

| | | | |
|---|---|---|---|
| 3,279,936 | 10/1966 | Forestek | 427/142 X |
| 3,502,493 | 3/1970 | Forestek | 427/191 X |
| 3,904,346 | 9/1975 | Shaw et al. | 427/184 X |

*Primary Examiner*—Evan Lawrence
*Attorney, Agent, or Firm*—Walter J. Monacelli

[57] ABSTRACT

A method for the application of chilled particles such as polytetrafluoroethylene generally marketed under the trade mark "TEFLON", graphite, molybdenum sulfide and boron nitride to a metal surface having crevices or pores therein. With the metal heated to expand the crevices or pores and the particles chilled to contract them, the particles will be locked into the pores when both the metal and the particles come to equilibrium temperature with the particles thereby expanding and the pores contracting. The method is directed to such an application of chilled particles to expanded pores in large metal objects such as for example, large rolls. The large object is rotated on its linear axis while maintained at the desired temperature and the particles are given an electrostatic charge and chilled prior to their application to the metal surface. Apparatus for effecting this application of electrostatically charged chilled particles includes structure for rotating a large metal object about its linear axis, heating the object, and electrostatically charging and chilling particles prior to their application by spraying to pores and crevices in the metal surface. Portable heating and spraying devices are utilized. Each of the heating and spraying devices is adapted to be moved to a position adjacent the object and to be moved away after performance of its function following which the other device may be moved into a position adjacent the object for performance of its function.

9 Claims, 1 Drawing Sheet

FIG. 1
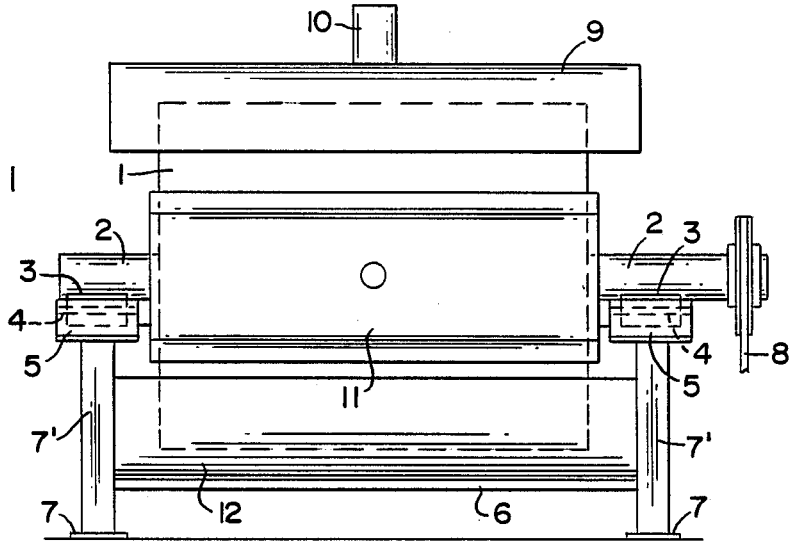
FIG. 2
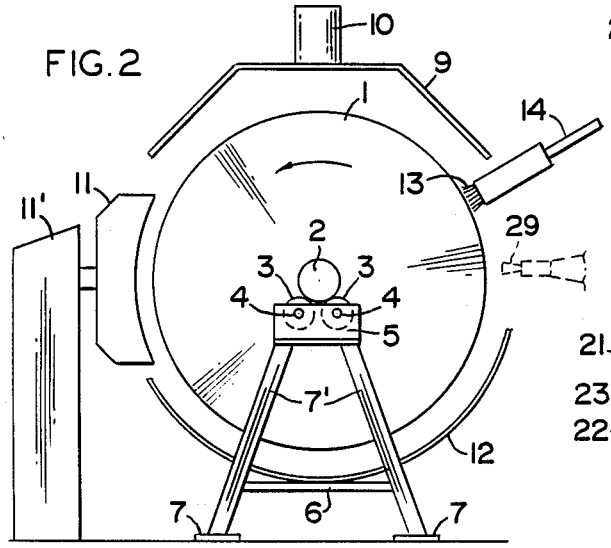
FIG. 3
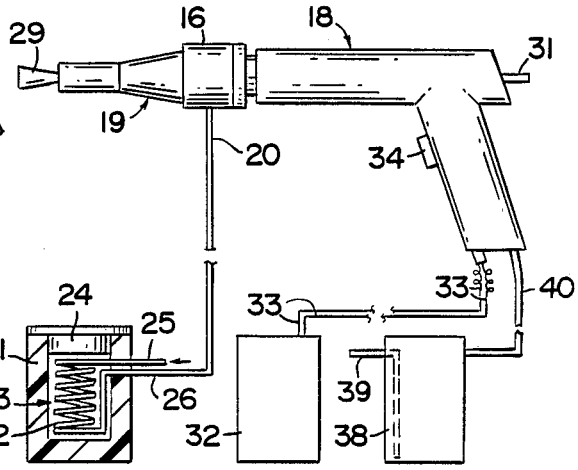
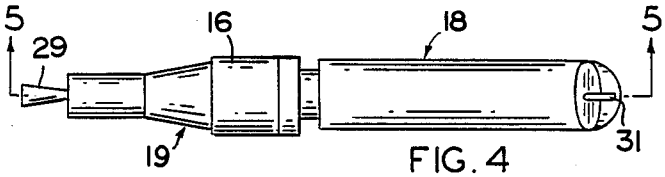
FIG. 4
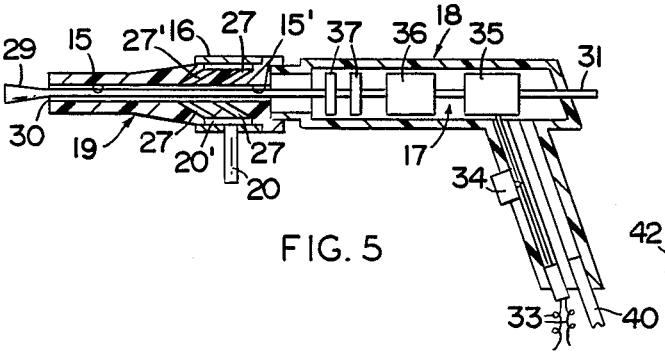
FIG. 5
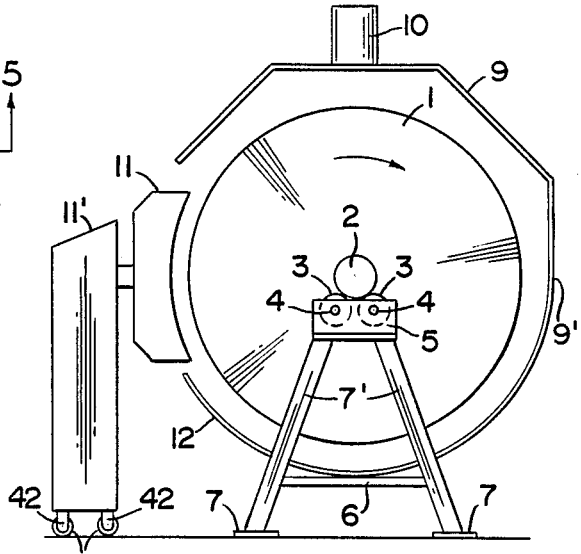
FIG. 6

APPARATUS FOR APPLYING ELECTROSTATICALLY CHARGED PARTICLES TO THE SURFACE OF A LARGE METAL ARTICLE

This application is a continuation-in-part of application Ser. No. 821,802, filed Jan. 23, 1986, now abandoned.

BACKGROUND OF THE INVENTION

1. Field of the Invention

This invention relates to a process and apparatus for applying chilled finely divided particles to the surface of a large metal object having crevices or pores therein. More specifically, it relates to a method for chilling and applying electrostatically charged particles to such an object. Still more specifically it relates to a method of rotating and maintaining the large object at the desired raised temperature during the application of the chilled particles. Still more specifically it relates to apparatus for effecting this process.

2. Description of the Prior Art

U.S. Pat. No. 3,279,936, issued to Clarence W. Forestek on Oct. 18, 1966, is directed to the treating of metal surfaces having crevices or pores therein with perfluorocarbon polymer particles so as to deposit such particles into the pores. By having the metal at a raised temperature to enlarge the pores and the particles chilled to contract them, the particles are interlocked in the pores when the particles and the metal come to an equilibrium temperature whereby the particles are expanded and the pores contracted.

U.S. Pat. No. 4,051,275 issued on Sept. 17, 1977 was also granted to Clarence W. Forestek and is directed to applying such chilled particles in a fluid stream carrying finely divided particles applied at a pressure of 30–120 psi to compact previously deposited particles and thereafter depositing additional particles in the space freed by the compaction, said additional particles being a temperature at least 100° F. below the temperature of the metal surface so that these additional particles will also be locked into the fissures upon reaching equilibrium temperature.

OBJECTIVES OF THE INVENTION

It is an objective of this invention to said in the depositin of such finely divided particles into crevices and pores in the surface of metal objects, particularly large objects, by placing an electrostatic charge on these particles.

It is also an objective of this invention to place an opposite charge on the object to be impregnated with the particles.

It is also an objective of this invention to apply the electrostatically charged particles in a blast of fluid medium in which the electrostatically charged particles are directed against the metal surface and into its crevices and pores.

It is also an objective of this invention whereby the blasting of the electrostatically charged particles effects a compaction of the particles already in the crevices and pores so as to increase the free space therein thereby increasing space for additional particles to be deposited therein.

It is also an objective of this invention that the object, particularly large objects, can be rotated on an axis so as to expose the deposited particles to repeated compaction upon repeated revolutions so as to effect additional free space for additional deposition of chilled particles.

It is also an objective of this invention to design an apparatus for the rotation of large objects while said electrostatically charged chilled particles are blasted thereon.

SUMMARY OF THE INVENTION

In accordance with the present invention it has been found that the application of finely divided chilled particles of perfluorocarbon polymer or graphite, molybdenum sulfide, boron nitride or other suitable electrostatically charged particles to the surface of a metal object, particularly large objects, having crevices or pores in said surface can be facilitated and more adequately effected by rotating the object on its linear axis and maintaining the object at a raised temperature while applying chilled finely divided electrostatically charged particles of perfluorocarbon, etc., onto the surface thereof. Advantageously the object is substantially enclosed in a hood or shield which protects heat loss from the object. While the object is maintained at the desired temperature, a stream of the chilled electrostatically charged, finely divided particles suspended in dry air or in an inert gas such as helium, nitrogen, argon, etc., is directed against the metal surface so as to deposit and impinge such particles into the crevices or pores and to compact particles which had been previously deposited in the crevices or pores.

The electrostatic charge applied to the particles is advantageously in the range of 50–150 kilovolts, preferably about 100 kv. Preferably, the particles are given a positive charge and the object is given a minus potential. However, while this system is preferred, the reverse system of charging may be used. Any appropriate means may be used for applying this charge, but a particularly advantageous device is described in another application being filed by this inventor on the same date herewith. This device comprises a spray gun, such as used for electrostatically spraying paint which has an interior channel through which is passed the spraying medium, in this case the suspension of particles dispersed in dry air or inert gas, is mixed with a chilled gas. A cooling medium such as liquid nitrogen or solid carbon dioxide is maintained in an adjacent vessel so that a chilling effect can be imparted to the gaseous suspension medium by introducing a chilled gas, preferably the same as used in the original suspension, into the suspension of electrostatically charged particles during its passage through a passageway of the chilling apparatus. Prior to the chilling of the gaseous suspending medium, electrostatic charges are applied to the particles by passing the suspension of particles through an electrical field effected by electrodes positioned in the chamber of the spray gun. Appropriate electrical charge for the electrodes is maintained by a high voltage transformer and condensers.

The chilled gas introduced into the suspension is desirably maintained at −20° C. (−4° F.) to −130° C. (−202° F.), preferably −50° C. (−58° F.) to 120° C. (−184° F.). While the method of chilling the suspending gas and the suspended particles may comprise any suitable means for effecting this chilling condition, a particularly effective means is the chilling apparatus shown hereinafter for attachment to the front of a spray gun. This preferred chilling apparatus is considered patentable per se and is claimed in a companion application filed concurrently herewith.

The spray gun may be any one of a number of commercial spray guns suitable for spraying electrostatically charged particles. A particularly suitable spray gun is the one marketed under the trademark "GEMA" which has a four electrode and high voltage generating system including a high voltage transformer and a high voltage set of condensers. The cooling attachment is fitted onto the front or spraying end of the spray gun so that as the spray of suspended electrostatically charged particles emanate from the spray gun they pass through a passageway in the chilling apparatus and out over impact spreading cone.

The polymer suspension stream is advantageously ejected from the spray gun at a pressure of 15–150 psi (1–10 atmosphere). A suspension of particles in the suspension medium is advantageously kept in a storage tank in which the particles are stirred up by feeding in nitrogen or other gas. When the stream is to be applied, the appropriate valve is opened to allow the gas to escape with particles suspended therein and carried to the electrostatically charging chamber of the spray gun prior to mixing with the chilling gas medium. Various other means may be used to feed polymer particles into the gas stream such as Venturi, screw feed, blower, pump, etc.

Although large objects of various shapes may be treated by the process of this invention, it is particularly suitable for cylindrical objects, including large rolls 1800 millimeters (70.86 inches) or more in diameter and 2500 millimeters (98.4 inches) or more in length. If the object does not have end walls or support at the two ends of the cylinder or other shape, these may be affixed for the purpose of making the cylinder or other object rotatable on its linear axis. A supporting axle may be affixed concentric with the linear axis and this axle driven by a motor at a controlled rate of rotation, advantageously at about 0.1 to 10 revolutions per minute, with the axle desirably resting on roller bearings.

As previously indicated a hood or other partial cover may be used to shield the object against loss of heat, and also during the spraying operation an exhausting suction may be applied under this hood to remove the gas carrying the particles as well as the remaining particles still suspended therein. The particles which fall below the object may be collected and reapplied if desired.

The desired temperature of the object to be treated may be attained by applying a stream of hot air under the hood and against the object as it is rotated. Infrared or other appropriate means of heating may be used if desired. The hood has a slot or open area running the length of the object and parallel to the axis of the object through which the electrostatic spraying is to be affected. If desired there may be a sliding or hinged door to cover this open area when spraying is not being affected. While the object may be maintained at a temperature as low as 38° C. (100.4° F.), it is advantageously maintained at a temperature of about 150°–180° C. (302°–356° F.). The hot air or other means of applying heat is shut off during the spraying operation after which the hood is removed and the object is allowed to cool. During the spraying operation the chilled particles have a temperature at least 55° C. (130.5° F.) preferably at least 165° C. (329° F.) below the temperature of the object.

For a roller or cylinder one inch in thickness, 1800 millimeters (70.86 inches) in outer diameter and 2500 millimeters (98.4 inches) long, it generally takes about 12 hours for the temperature to drop from 150° C. to 60° C. For the spraying operation, such a roll may be satisfactorily sprayed in about ½ hour with three operators applying the spray manually with hand-held spray guns. If desired, a plurality of spray guns may be held on a rack which is moves, either manually or mechanically, in a path parallel to the axis of the object, the rate of such parallel movement being adjusted in accordance with the rate of rotation of the object to give complete coverage of the object's surface by the sprayed particles.

A stain appearance on the object's surface indicates insufficient impregnation of the crevices and pores with the particles. Spraying is continued until the stain appearance disappears. In some cases satisfactory results may be obtained with 5 complete revolutions. Preferably 20 or more revolutions produce the desired results and generally there is no additional advantage in exceeding 120 revolutions.

A felt strip or brush with soft rollers extending down from the hood, at a point beyond the spraying area, to the surface of the object and extending along the length of the object effects a wiping operation to brush particles into crevices and pores and also to wipe away particles on the surface of the object between the crevices and pores. This wiping may be effected continuously after the spraying operation or may be done periodically. It is generally satisfactory to perform this wiping operation at least 4 or 5 or more times.

During the spraying operation the spray gun or guns are advantageously held about 300–500 mm (12–20 inches) from the object being sprayed. It is generally sufficient to effect the spraying during 20–100 revolutions of the object. As indicated above, the spraying is continued or repeated until the stained appearance no longer appears after wiping.

The speed of the particles toward the object is determined by the pressure of the suspending gas and the voltage of the electrostatic field. While it is preferred to feed the particles into the gas prior to or during passage of the gas through the spray gun, it is also contemplated that the particles may be fed into the gas stream after the gas emanates from the gun in which case the particles will pick up the electrostatic charge on the way to the object's surface. However it is preferred to apply the electrostatic charge to the particles before chilling the particles and to effect the chilling of the particles by mixing a chilled gas with the suspension of charged particles.

For particles of $4.7^{-10}$ gm or 5 microns in size and a voltage of about 80–100 kilovolts applied between the gun and the object it is estimated that the particles have an initial velocity of about 11 meters per second and about 0.09–0.10 meters per second in the vicinity of the workpiece. Smaller sized particles, e.g., of less than 1 micron are more favorable since the ultimate speed due to the electrical feed will be higher than for larger particles.

In applying the electrostatic charge it may be advantageous to have a series of electrodes spaced in pairs along the path of the suspended particles with a voltage of approximately 20 killovolts applied between each pair of electrodes and applied transversely to the direction of flow of the gas.

SPECIFIC EMBODIMENT OF THE INVENTION

The description of the process and apparatus of this invention are facilitated by reference to the drawings.

FIG. 1 is an elevational front view of a roll mounted in a hood for spraying.

FIG. 2 is an elevational end view of the roll and hood of FIG. 1.

FIG. 3 is a side elevational view of a spray gun adapted to effect cooling of a gas stream with suspended particles and to supply electrostatic charge to the particles.

FIG. 4 is a top view of the front portion of spray gun shown in FIG. 2.

FIG. 5 is a side cross-sectional view of the front portion of the spray gun shown in FIGS. 2 and 3 taken at line 5—5 of FIG. 3.

FIG. 6 is an end elevational view of a roll mounted in a hood extending a greater distance around the roll with an opening of one side for exposure to a portable heater and a portable spray unit.

In FIG. 1 roll 1 is supported by axle 2 which in turn rests on bearings 3 which rotate on supporting pins 4 fastened to supporting standard 5 which has legs 7', crossbars 6 and base plates 7. Axle 2 is rotated by a belt or chain 8 which is driven by a motor means (not shown) to give the desired rate of rotation to roll 1. Hood 9 is positioned above roll 1 and has exhaust outlet 10. If desired the hood may extend down further to embrace a larger portion of roll 1.

FIG. 2 is an elevational end view of the apparatus of FIG. 1. Heating means 11 is shown positioned on one side (or in back) of roll 1 with supporting means 11'. The spray gun (not shown in this view) is positioned on the opposite side (or in front) of roll 1. Felt or soft bristles 13 are positioned next to the roll 1 above the spray area and are held by support means 14.

FIG. 3 is a side elevational view of spray gun attachment 19 designed to effect cooling of a gas stream after applying electrostatic charges to particles suspended in the gas stream. The cooling nozzle 19 is preferably made of polytetrafluoroethylene (PTFE). Metal ring or band 16 slides over the exterior of a portion of the spray gun attachment 19 to hold gas entrance duct 20 in position. Cold gas such as nitrogen is fed into the spray gun from cooling tank 21 which preferably consists of a rigid, expanded polyurethane foam in which a heat exchange coil 22 is positioned in cooling chamber 23. The coil is advantageously made of copper tubing having a diameter of about 10 mm. Cover 24 closes the chamber to reduce the admission of heat. The coolant contained in the cooling chamber is advantageously either dry ice (solid carbon dioxide) or liquid nitrogen. When the gas inlet line 25 is opened, gaseous nitrogen, or other preferred gas, flows through cooling coil 22 and the cooled gas (preferably at −70°-140° C.) flows through hose connector 26 to gas entrance duct 20 attached to and communicating with the recessed portion 20' running around the circumference of attachment 19 and feeding cold gas through channels 27 into the interior of the chamber 15 of cooling attachment 19.

FIG. 4 is a top view of the cooling attachment 19 and spray gun 18 shown in FIG. 2.

FIG. 5 shows the interior structure of the cooling attachment and spray gun taken at line 5—5 of FIG. 4. Nozzle 19 has a gas duct 20 which is fixed in position and is sealed by means of a metal ring 16. Hose 26 (shown in FIG. 3) feeds chilled gas into gas duct 20. From duct 20 the chilled gas is passed through channels 27 into mixing channel 15 where the electrostatically charged particles are cooled down to the desired low temperature, preferably approximately −120° C. (−184° F.) and then sprayed onto the roll or other large object being rotated in front of the spray gun, which object is grounded so as to attract and hold the electrostatically charged particles. Conical impact plate 29 is positioned at the outlet end 30 of mixing channel 15 and can adjust the cloud of power to the desired size by appropriate positioning of the impact plate 29 by longitudinal movement of rod 31. High voltage preferably in the range of 70–125 kv is developed in generator 32 and transmitted through lines 33 into the interior of the spray gun through switch 34 to high voltage condenser cascade 35 and then through high voltage transformer 36 to electrodes 37. Meanwhile particles of the desired size and type are stored in reservoir 38 maintained in suspended state by gas admitted by line 39 at the bottom of the reservoir from which the gas stream conveys the suspended particles through hose 40 into the spray gun where they are electrostatically charged as they pass between electrodes 37 into mixing channel 28 where the particles are chilled to the desired low temperature by mixture with the cold gas being admitted through duct 20.

FIG. 6 is an end view of the roll arrangement as shown in FIG. 2 except that the hood extends further around the roll by the addition of hood extension 9'. In place of the heater arrangement shown in FIG. 2, the heater 11 and heater support 11' are made portable by means of wheels 41 fastened to the heater support 11' by supports 42. The heat source is not shown but may be electrical, e.g., hotwire, or heatlamps, or hot air fed by flexible ducts leading into heater 11. When the roll is properly located, the portable spray gun (not shown) is moved into the position vacated by the heater and soft brush 13 is moved in a position above the spray gun. With the rotatable spray gun positioed on the opposite side of the roll it may be desirable to rotate the roll in the opposite direction from that shown in FIG. 2.

Both the heating means for applying heat to the large object to be treated and the means for spraying the chilled, electrostatically charged, gas-suspended particles onto the heated surface of the large object are preferably portable and moved to a position adjacent the large object for the performance of their functions. While it is preferred to have each of these means alternately occupy the same space adjacent to the large object, it is also possible to have the two means occupy different spaces adjacent to the large object for the performance of their respective functions.

While certain features of this invention have been described in detail with respect to various embodiments thereof, it will of course be apparent that other modifications can be made within the spirit and scope of this invention, and it is not intended to limit the invention to the exact details shown above except insofar as they are defined in the following claims.

The invention claimed is:

1. Apparatus for the application and compaction of chilled finely divided particles into the pores and crevices of the metal surface of a large object comprising the combination of:

(a) a means for supporting and rotating said large object about its linear axis at a controlled rate of rotation;

(b) a heating means for applying heat to said large object until the temperature of said metal surface is sufficient to give a desired increase in the size of said pores and crevices for receiving finely divided particles;

(c) a charging means for applying electrostatic charges to finely divided particles while suspended in a gaseous medium;

(d) a second charging means for applying an opposite charge to said large object from that applied on said particles;

(e) a cooling means for chilling said electrostatically charged particles; and (f) a means for spraying said chilled electrostatically charged, gas-suspended particles onto the said heated surface of said large object and depositing said particles into the pores and crevices in the metal surface of said large object, said rotatable large object being surrounded for a substantial portion of the upper area of said object by a hood adapted to reduce heat loss from said object and being surrounded for a substantial portion of the underside area of said object by a catch basin adapted to catch particles falling from the surface of said object and also adapted to further shield said object from heat loss; said heating means and said spraying means both being portable and each means being adapted to be moved to a position adjacent to the said object and to be moved away from said object after performance of its function following which the other means may be moved into a position adjacent to the said object for performance of its function.

2. The apparatus of claim 1, in which the said heating means comprises a means for directing a heated gas against the surface of said object.

3. The apparatus of claim 2, in which said hood has an exhaust duct connected thereto through which said heated gas may be exited after it has flowed over a portion of said large object.

4. The apparatus of claim 3, in which said adjacent position is the same for both said spraying means and said heating means.

5. The apparatus of claim 4, further comprising a brushing means positioned so as to contact the said object after the sprayed particles have been placed on the surface of said object whereby said contact of said brushing means with said object serves to brush particles into said crevices and pores and to wipe off particles from the surface of said object between said crevices and pores.

6. The apparatus of claim 1, in which said adjacent position is the same for both said spraying means and said heating means.

7. The apparatus of claim 6, further comprising a brushing means is positioned so as to contact the said object after the sprayed particles have been placed on the surface of said object whereby said contact of said brushing means with said object serves to brush particles into said crevices and pores and to wipe off particles from the surface of said object between said crevices and pores.

8. The apparatus of claim 6, in which the said heating means comprises a means for directing a heated gas against the surface of said object.

9. The apparatus of claim 6, in which said heating means comprises a means for directing a heated gas against the surface of said object, and said hood has an exhaust duct connected thereto through which said heated gas may be exited after it has flowed over a portion of said large object.

* * * * *

UNITED STATES PATENT AND TRADEMARK OFFICE

CERTIFICATE OF CORRECTION

PATENT NO. : 4,850,302

DATED : July 25, 1989

INVENTOR(S) : Reinhold Hoffman

It is certified that error appears in the above-identified patent and that said Letters Patent is hereby corrected as shown below:

Col. 1, line 48, correct "depositin" to read "deposition".
Col. 4, line 5, correct "moves" to read "moved".
Col. 5, line 52, correct "-70°-140°C"to read "-70° - -140°C."
Col. 6, line 35, correct "positioed" to read "positioned".

Signed and Sealed this

Fifteenth Day of May, 1990

*Attest:*

*Attesting Officer*

HARRY F. MANBECK, JR.

*Commissioner of Patents and Trademarks*